US005486088A

United States Patent [19]

Brandon

[11] Patent Number: 5,486,088

[45] Date of Patent: Jan. 23, 1996

[54] STEAM TURBINE STEAM STRAINER

[76] Inventor: Ronald E. Brandon, 627 Jubilee St., Melbourne, Fla. 32940

[21] Appl. No.: 344,862

[22] Filed: Nov. 25, 1994

[51] Int. Cl.[6] ..... F03B 11/08

[52] U.S. Cl. ..... 415/121.2; 55/467; 137/549

[58] Field of Search ..... 415/121.2; 55/467; 137/625.3, 549

[56] References Cited

U.S. PATENT DOCUMENTS

| | | | |
|---|---|---|---|
| 3,044,484 | 7/1962 | Dunning | 137/549 |
| 4,024,891 | 5/1977 | Engel et al. | 137/625.3 |
| 4,077,739 | 3/1978 | Heilenbach | 415/121.2 |
| 4,134,425 | 1/1979 | Güssefeld et al. | 137/625.3 |
| 5,014,746 | 5/1991 | Heyman | 137/625.3 |

FOREIGN PATENT DOCUMENTS

| | | | |
|---|---|---|---|
| 0966332 | 10/1932 | Australia | 137/625.3 |
| 2619403 | 11/1977 | Germany | 415/121.2 |
| 0286291 | 4/1935 | Italy | 415/121.2 |
| 0197401 | 11/1983 | Japan | 415/121.2 |
| 0121552 | 4/1948 | Sweden | 415/121.2 |

*Primary Examiner*—Edward K. Look
*Assistant Examiner*—Mark Sgantzos
*Attorney, Agent, or Firm*—Ross, Ross & Flavin

[57] ABSTRACT

In a steam turbine inlet which includes an annular steam strainer stationarily positioned therein for stopping the passage into the turbine of large metal particles, the improvement in the strainer which comprises a plurality of spaced through holes in a major portion of the strainer circumference, the through holes being of differing diameters, with holes of like diameter being positioned in longitudinally-extending, circumferential zones, holes of the largest diameter being disposed in zones where metal particles are least likely to enter the holes, holes of smaller diameter being disposed in zones where metal particles are most likely to enter the holes, and a longitudinally-extending zone in the strainer without holes where the particles velocity and direction of movement would be damaging to any holes located in such a zone.

3 Claims, 2 Drawing Sheets

STEAM TURBINE STEAM STRAINER

BACKGROUND OF THE INVENTION

1. Field of the Invention

This invention relates to steam turbines and the devices used to stop large particles carried by the inlet steam from entering the turbine.

2. Description of the Prior Art

All steam turbines include strainers to capture particles carried by steam from the boiler and to prevent the particles from entering the turbine where serious damage could occur.

Existing turbines use one of two general types of strainers.

The first type is a cylinder with large holes that are arranged to permit a screen with smaller openings to be wrapped around the cylinder, thus having the ability to stop steam carried particles larger than approximately ⅛ inch in size. This same system can also permit the temporary addition of a finer mesh screen for brief operating periods when the presence of particles from the boiler is known to be a serious threat. This type of strainer presents a minor deficiency in that the screen itself may fail with time and operating use thus causing internal turbine damage of a serious nature. The steam pressure drop is also increased by the necessity of passing through both a screen and the strainer holes.

The second type of strainer is a simple cylinder with many small holes. The holes allow the passage of steam, but stop particles larger than the hole size selected. The holes selected vary from one turbine design to another, with some designers selecting approximately ¼ inch holes; while others use approximately 3/32 inch holes. This type strainer uses holes with square,sharp inlets, such that the flow coefficient is relatively small, causing a greater pressure drop of the steam entering the turbine. These holes are further vulnerable to inlet damage caused by high velocity particles which further reduces the effective flow area and increases the undesirable steam pressure drop.

SUMMARY OF THE INVENTION

It is the purpose of the invention to eliminate the risk of screen failures present in the first type of strainer described above; further, to reduce the maximum size of particle that will pass through the strainers; and still further, to reduce the operating pressure drop required of the steam flow in any of the strainers. And, additionally, to simplify the use and maintenance of the strainers.

DESCRIPTION OF THE PREFERRED EMBODIMENTS

Figure 1:
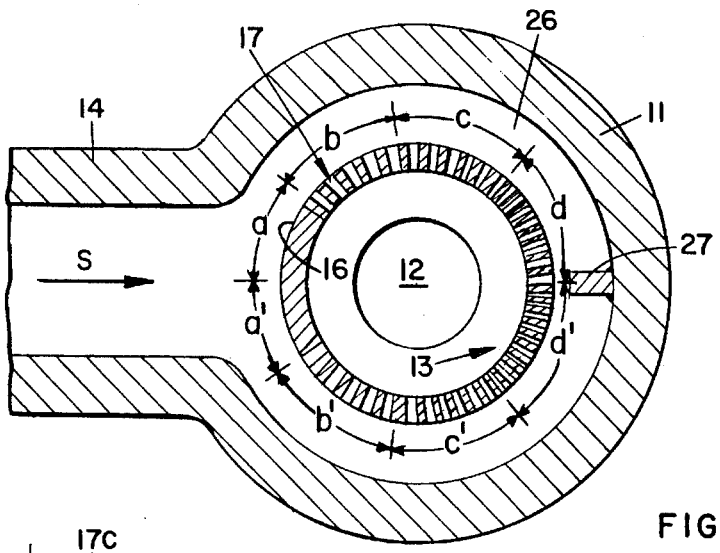
FIG. 1 is a fragmentary, cross-sectional plan view of a strainer embodying the invention mounted in a turbine stop valve casing.

FIG. 1 is a fragmentary cross sectional plan view of a turbine stop valve casing 11. Entering the valve casing is a steam entry line 14 with the direction of steam flow shown by arrow S, Contained inside casing 11 is a cylindrical steam strainer 13 embodying a preferred form of the invention and having a plurality of rows of spaced parallel holes, generally indicated by 17 which extend through the strainer wall.

All steam must pass through holes 17 in the strainer wall, the purpose of the holes being to stop the passage of large metallic particles from the boiler, not shown, into the turbine, also not shown.

An annular passage 26 in casing 11 surrounds strainer 13 and allows steam to flow between the valve casing and strainer so as to permit steam access to all the holes 17 in the strainer. A partial blockage of the annular passage 26 is provided by an abutment 27 disposed opposite steam entry line 14 to minimize circulation of steam or particles.

After passage through holes 17 in strainer 13, the steam flows through a valve discharge pipe 12, and then into the turbine, not shown. Flow is prevented from by-passing the strainer by metal-to-metal contact at both ends of the strainer by a valve casing cover (not shown) at the strainer upper end and by the inside of the valve casing at the strainer lower end.

Figure 2:
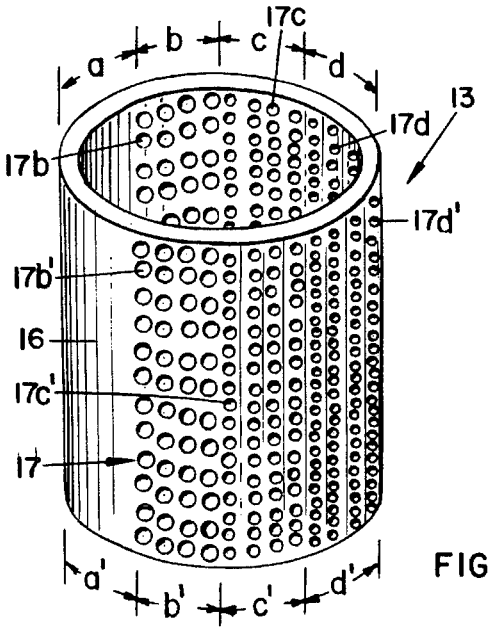
FIG. 2 is a perspective view of the strainer of FIG. 1.

FIG. 2 is a perspective view of cylindrical steam strainer 13. Holes 17 are provided in a major portion of the circumference of the strainer wall. However, a portion 16 of the strainer where high velocity steam from steam entry line 14 impacts the strainer is not provided with holes in a longitudinally-extending circumferential zone identified by the letters a and a'.

Holes **17*b*–17*d* of varying diameters are provided in spaced longitudinally-extending circumferential zones b–d and holes 17*b*'–17*d*'** of varying diameters are provided in spaced zones b'–d' throughout the remainder of the strainer circumference.

In zones b and b', located on either side of portion 16 and zones a and a', respectively, holes **17*b* and 17*b*** ' are relatively large in the order of ¼ inch diameter.

In zones c and c', located on either side by zones b and b' respectively, holes **17*c* and 17*c*** ' are slightly smaller and are of medium size in the order of ⅛ inch diameter.

In zones d and d', located on either side of zones c and c' respectively, small holes **17*d* and 17*d*** ' are provided, in the order of 3/22 inch diameter.

Figure 3:
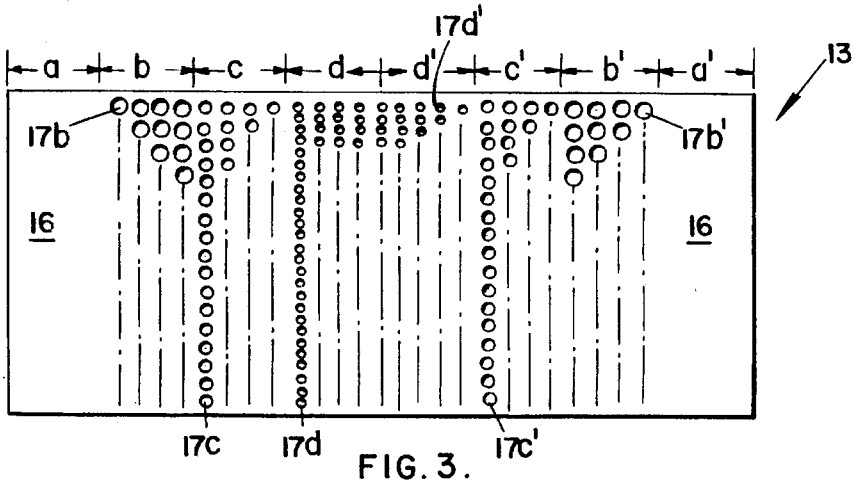
FIG. 3 is a plan view of the strainer of FIG. 2 shown in an unrolled or flat condition.

The relationship of the various zones a–d and a'–d' is graphically displayed in FIG. 3, wherein the strainer wall is layed flat.

With this zoned arrangement, relatively large holes **17*b* and 17*b* ' are used in zones b and b' where the particles have little chance of entry, while small holes 17*d* and 17*d* ' are used in zones d and d' where the bouncing particles have the best chance of entry. The particles adjacent to zones b and b' are traveling through annular passage 26 in a direction generally perpendicular to the axes of holes 17. The particles adjacent to zones d and d' are bouncing and being stirred by the steam to be moving in random directions; thus the particles are more likely to enter holes 17** in these zones, especially if these holes were large.

Figure 4:
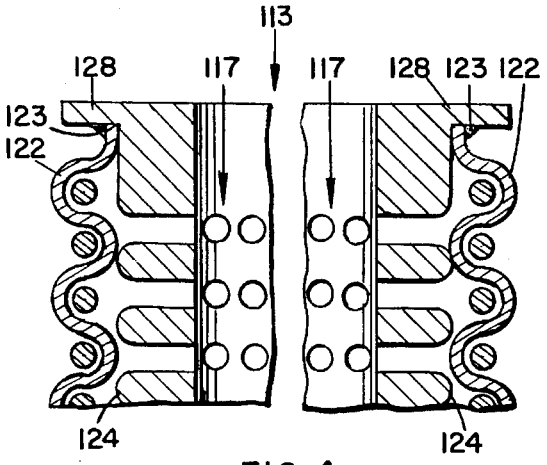
FIG. 4 is an enlarged fragmentary broken cross sectional view taken transversely through a modified form of strainer as shown in FIG. 6.
Figure 5:
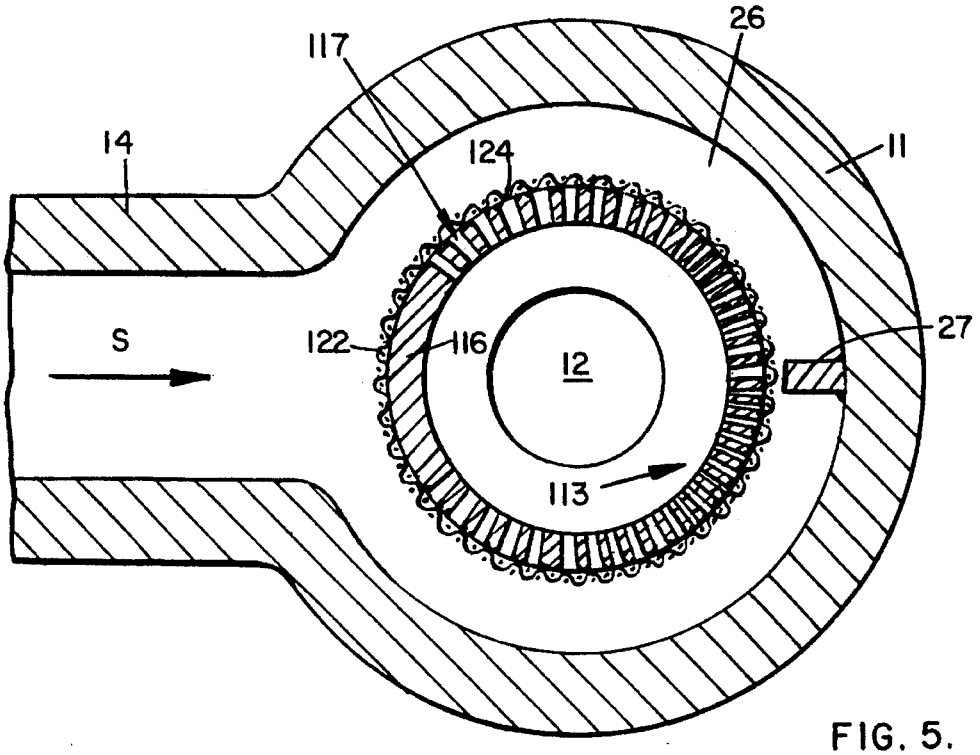
FIG. 5 is a fragmentary, cross-sectional plan view of the modified strainer of FIG. 4 mounted in a turbine stop valve casing.
Figure 6:
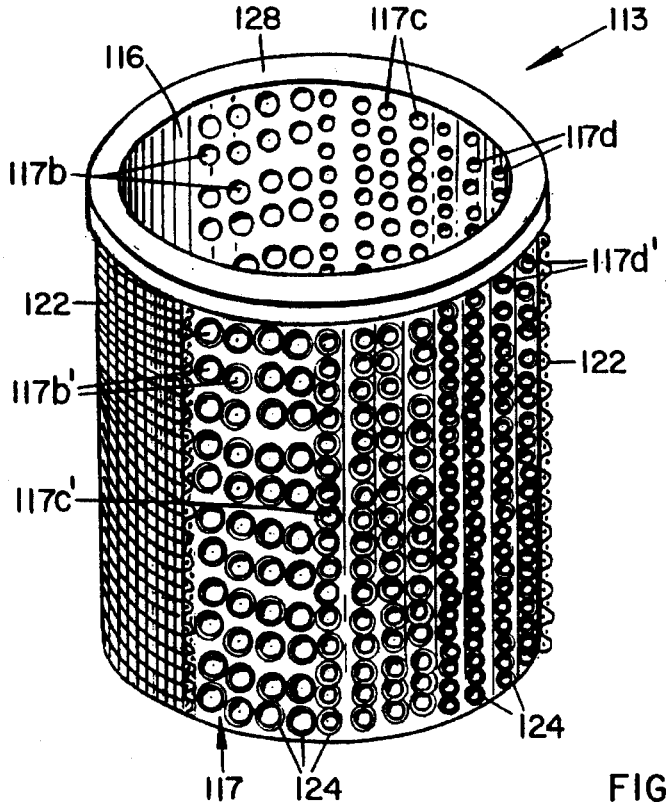
FIG. 6 is a perspective view of the modified strainer of FIG. 4 with the screen broken away for clarity.

FIGS. 4–6 illustrate a strainer 113 embodying a modified form of the invention.

In this embodiment, a fine mesh screen 122 is fixed to the outer periphery of strainer 113 at its inlet as by welding at 123, and/or by rivets or bolts, not shown; and strainer 113 replaces strainer 13 centrally of casing 11.

Strainer 113 with its mesh screen 122 is used during temporary operating periods when particles from the boiler are most probable. A shoulder 128 protects the mesh.

As with strainer 13 of FIGS. 1–3, holes 117 are provided in a major portion of the circumference of strainer 113. However, a longitudinally-extending, circumferential portion or zone 116 of the strainer where high velocity steam from steam entry line 14 impacts the strainer is not provided with holes.

In strainer 113, holes 117*b*–117*d* and holes 117*b'*–117*d'* of varying diameters are provided in spaced, longitudinally-extending, circumferential zones throughout the remainer of the strainer wall.

Holes 117 have rounded inlets 124 to minimize steam pressure drop and also to minimize damage to the hole caused by particle impact.

It is to be noted that steam strainers of the invention are applicable to both high pressure and reheat turbine inlets.

I claim:

1. In a steam turbine inlet which includes an annular steam strainer stationarily positioned therein for stopping the passage into the turbine of large metal particles, the improvement in the strainer which comprises:

a plurality of spaced through holes in a major portion of the strainer circumference, the through holes being of differing diameters, with holes of like diameter being positioned in longitudinally-extending, circumferential zones, holes of the largest diameter being disposed in zones where metal particles are least likely to enter the holes, holes of smaller diameter being disposed in zones where metal particles are most likely to enter the holes, and a longitudinally-extending, circumferential zone in the strainer without holes where the particle velocity and direction of movement would be damaging to any holes located in such a zone.

2. In an improved strainer according to claim 1, wherein a fine mesh screen is positioned outwardly of and protects the zoned holes.

3. In an improved strainer according to claim 1, wherein the holes have rounded inlets to minimize steam pressure drop and particle damage to the holes.

* * * * *